US007629047B2

(12) United States Patent
Hendriks et al.

(10) Patent No.: US 7,629,047 B2
(45) Date of Patent: Dec. 8, 2009

(54) ARAMID FIBRILS

(75) Inventors: Anton Johannes Josef Hendriks, Lent (NL); Jan Davis Cornelis Tiecken, Didam (NL); Harrie Grotendorst, Duiven (NL); René Journee, Duiven (NL); Mirjam Ellen Oldenzeel, Westervoort (NL)

(73) Assignee: Teijin Aramid B.V., Arnhem (NL)

( * ) Notice: Subject to any disclaimer, the term of this patent is extended or adjusted under 35 U.S.C. 154(b) by 376 days.

(21) Appl. No.: 10/582,161

(22) PCT Filed: Nov. 30, 2004

(86) PCT No.: PCT/EP2004/013542

§ 371 (c)(1),
(2), (4) Date: Jun. 8, 2006

(87) PCT Pub. No.: WO2005/059211

PCT Pub. Date: Jun. 30, 2005

(65) Prior Publication Data

US 2007/0082198 A1 Apr. 12, 2007

(30) Foreign Application Priority Data

Dec. 9, 2003 (EP) ..... 03028091

(51) Int. Cl.
*D02G 3/02* (2006.01)
*D21H 13/26* (2006.01)

(52) U.S. Cl. ..... 428/359; 428/357; 428/395; 264/140; 264/142; 264/183; 162/157.1; 162/157.3

(58) Field of Classification Search ..... None
See application file for complete search history.

(56) References Cited

U.S. PATENT DOCUMENTS

| | | | | |
|---|---|---|---|---|
| 4,963,298 | A | 10/1990 | Allen et al. | |
| 5,028,372 | A | 7/1991 | Brierre et al. | |
| 5,202,184 | A | 4/1993 | Brierre et al. | |
| 5,296,286 | A | 3/1994 | Allen et al. | |
| 5,442,003 | A | 8/1995 | Takahashi et al. | |
| 6,942,757 | B1 * | 9/2005 | Iwama et al. ..... | 162/157.3 |

FOREIGN PATENT DOCUMENTS

| | | | |
|---|---|---|---|
| EP | 0 348 996 | A2 | 1/1990 |
| EP | 0 381 206 | A2 | 8/1990 |

* cited by examiner

*Primary Examiner*—Jill Gray
(74) *Attorney, Agent, or Firm*—Oliff & Berridge, PLC

(57) ABSTRACT

Aramid fibrils having in the wet phase a Canadian Standard Freeness (CSF) value less than 100 ml, after drying a specific surface area (SSA) less than 7 $m^2/g$, and a weight weighted length for particles having a length >250 μm (WL 0.25) less than 1.2 mm, are described. A method of preparing the fibrils includes the steps (a) polymerizing an aromatic diamine and an aromatic dicarboxylic acid halide to an aramid polymer, in a mixture of N-methylpyrrolidone or dimethylacetamide and calcium chloride or lithium chloride to obtain a dope wherein the polymer is dissolved in the mixture and the polymer concentration is 2 to 6 wt. %, (b) converting the dope to fibrils by using a jet spin nozzle under a gas stream, and (c) coagulating the fibrils using a coagulation jet.

16 Claims, No Drawings

ARAMID FIBRILS

CROSS-REFERENCE TO RELATED APPLICATION

The present application is a U.S. national stage application of PCT/EP2004/013542, filed Nov. 30, 2004, and claims priority to EP 03028091.1, filed Dec. 9, 2003 in Europe. The entire disclosures of the prior applications are each incorporated in its entirety herein by reference.

BACKGROUND

The present invention pertains to aramid fibrils, to a method of preparing said fibrils, and to paper made thereof.

Pulp is defined as fiber stem which is highly fibrillated. The fibrillated part is mentioned fibrils, which are highly entangled and have a high aspect ratio (>100) and a large surface area (8-10 $m^2/g$) which is about 40 times that of standard filament. Thus aramid pulps are fibrillated particles that are used for making paper, gaskets, breaking lines, and the like. Pulp generally can be made from spun fiber, by performing cutting and fibrillation steps thereon. It is however advantageous to directly make pulp, without first spinning the polymer to a fiber. Such direct pulp making method has been disclosed in the art, for instance in U.S. Pat. No. 5,028,372. According to this method, an aramid pulp was made by forming a para-aramid polymer solution, extruding said solution, having an inherent viscosity between 1 and 4, onto a conveyor, incubating the solution on the conveyor until it forms a gel, and cutting this gel and isolating the pulp thereof. The polymer has a concentration of 6 to 13 wt. % of the solution and the thus obtained pulp has a specific surface area greater than 2 $m^2/g$.

It can be envisaged that for particular applications a highly fibrillated pulp is advantageous. It would even be more advantageous that the polymeric material is fully (or essentially fully) in the fibril form, i.e., does not contain substantial amounts of fiber-like material. In other words, there is a need for "pulp" which predominantly contains the fibrillated part and no longer the fiber stems. Such material is unknown up to now. Very useful properties could be expected from such materials, such as high flexibility, high binding capacity in paper, and good porosity of papers made thereof. Further, it can be expected that such material has a considerable hardness after drying, and therefore suitable for using in composites. This material for the purpose of this invention is defined as "fibrils".

It is well known in the art that in pulp the higher the specific surface area (SSA), the lower the Canadian Standard Freeness (CSF). Thus in the standard reference work of Yang, 1993, Wiley & Sons, ISBN 0 471 93765 7, p. 156 it is explained that the CSF decreases when the SSA increases. It is an object of the present invention to provide materials having many of the properties of pulp, but having low SSA and at the same time low CSF. It can be envisaged that such material could have unique properties for many applications, including papermaking. Such materials are unknown in the art.

Fibers with a low fibrillation degree, having low SSA are known in the art. In EP 381206, subdenier pulp-like fibers have been disclosed. These fibers have been made by standard methods using high dope concentrations and using sulfuric acid as solvent. These fibers have low SSA, but high CSF (i.e., values above 600 ml).

In EP 348996 and U.S. Pat. No. 5,028,372, pulp has been made by a method wherein the polymerization is partly performed after extrusion and orientation of the dope. The pulp has low SSA (for instance, 5.2 and 7.1 $m^2/g$) and therefore according to Yang, p. 156, high CSF, i.e., >450 ml.

SUMMARY

The first objective of the present invention is therefore to provide an aramid polymer solution as a spinning dope, preferably exhibiting optical anisotropy, in order to obtain a spinning dope that can directly be spun without applying high pressure and/or high spinning temperature for making fibrils. Achievement of this objective makes it possible to produce aramid fibrils (as defined according to this invention) of predetermined length in one step. These fibrils are not only curved, but further contain kinks, wherein in each kink the direction of the fibril changes sharply to form an angle.

It is therefore also an objective of the present invention to provide fibrils that lose a large part of its fluffy character upon drying, but remain voluminous when wet. The fibrils according to this invention relate to aramid fibrils having in the wet phase a Canadian Standard Freeness (CSF) value less than 300 ml and after drying a specific surface area (SSA) less than 7 $m^2/g$. Fibrils according to the invention have a weight weighted length for particles having a length >250 μm ($WL_{0.25}$) less than 1.2 mm, more preferably less than 1.0 mm. These fibrils are characterized in that the lower the SSA is, the higher the CSF is.

The fibrils of this invention, which are not redispersable after drying, result in paper with very high paper strengths, and to very hard materials after drying.

DETAILED DESCRIPTION OF EMBODIMENTS

Preferred fibrils according to the invention have in the wet phase the CSF value less than 150 ml and an SSA less than 1.5 $m^2/g$.

The fibrils can be made from a meta and/or para-aramid polymer solution, such as poly(para-phenylene terephthalamide), poly(meta-phenylene isophthalamide), copoly(paraphenylene/3,4'-dioxydiphenylene terephthalamide) and the like, some of which polymers are commercially used in fibers and pulp available under the trade names KEVLAR®, TWARON®, CONEX®, and TECHNORA®. The preferred aramid is para-aramid, more preferably poly(para-phenylene terephthalamide).

Para-oriented aromatic polyamides are condensation polymers of a para-oriented aromatic diamine and a para-oriented aromatic dicarboxylic acid halide (hereinafter abbreviated to "para-aramids") and have hitherto been known to be useful in various fields such as fiber, pulp and the like because of their high strength, high elastic modulus and high heat resistance.

As typical members of para-aramid are mentioned the aramids of which structures have a poly-para-oriented form or a form close thereto, such as poly(paraphenylene terephthalamide), poly(4,4'-benzanilide terephthalamide), poly(paraphenylene-4,4'-biphenylenedicarboxylic acid amide) and poly (paraphenylene-2,6-naphthalenedicarboxylic acid amide). Among these para-aramids, poly(paraphenylene terephthalamide) (hereinafter abbreviated to PPTA) is most representative.

Hitherto, PPTA has been produced in polar amide solvent/salt systems in the following manner. Thus, PPTA is produced by carrying out a solution polymerization reaction in a polar amide solvent. The PPTA is precipitated, washed with water and dried, and once isolated as a polymer. Then, the polymer is dissolved in a solvent and made into a PPTA fiber by the process of wet spinning. In this step, concentrated sulfuric acid is used as the solvent of spinning dope, because PPTA is not readily soluble in organic solvents. This spinning dope usually shows an optical anisotropy.

Industrially, PPTA fiber is produced from a spinning dope using concentrated sulfuric acid as a solvent, considering the performances as a long fiber, particularly strength and stiffness.

According to the closest prior art EP 381206, a process is disclosed for preparing subdenier fibers from lyotropic liquid crystalline spinning dope. The process comprises 1) extruding a stream of an optically anisotropic solution of a polymer into a chamber, 2) introducing a pressurized gas into said chamber, 3) directing the gas in the flow direction of and in surrounding contact with said stream within the chamber, 4) passing both the gas and stream through an aperture into a zone of lower pressure at velocities sufficient to attenuate the stream and fragment it into fibers, and 5) contacting the fragmented stream in said zone with a trickle of coagulating fluid. The presently claimed process is adapted in order to prevent the formation of subdenier fibers and to facilitate the formation of fibrils.

With the aim of rationalizing the prior process, there have also been proposed up to date various other processes for directly making a pulp from a liquid polymer dope without separating the step of polymerization and the step of spinning from each other, among which the previously mentioned U.S. Pat. No. 5,028,372, however none of these produce (fiber-free) fibrils.

Yet another objective of the present invention is to overcome the disadvantages of the common pulp-making processes, by providing a process for producing a stable polymer solution and a product of uniform quality according to an industrially advantageous and simplified method, and to obtain fibrils with a high relative viscosity. In order to obtain material with high relative viscosity in one step, a polymer solution with low dynamic viscosity is required to easily form fibrils.

These and other objectives have been achieved by a process for making a polymer solution comprising the steps of:

a. polymerizing an aromatic diamine and an aromatic dicarboxylic acid halide to an aramid polymer, in a mixture of N-methylpyrrolidone or dimethylacetamide and calcium chloride or lithium chloride to obtain a dope wherein the polymer is dissolved in the mixture and the polymer concentration is 2 to 6 wt. %, b. converting the dope to fibrils by using a jet spin nozzle under a gas stream, and c. coagulating the fibrils using a coagulation jet.

In a preferred embodiment, the polymerization step is performed by at least partially neutralizing the hydrochloric acid formed. This method makes it possible to obtain an aramid polymer having a ηrel (relative viscosity) between 2.0 and 5.0.

According to a preferred embodiment of the invention a non-fibrous polymer solution of para-aramid in a mixture of NMP/$CaCl_2$, NMP/LiCl, or DMAc/LiCl has been made, wherein the polymer solution has a relative viscosity $\eta_{rel}$>2.2.

The dope is converted to the fibrils of the invention, by using a gas stream. Suitable gasses are, for example, air, oxygen, nitrogen, noble gas, carbon dioxide, and the like.

The aramid polymer solution of the present invention exhibits a low dynamic viscosity at a temperature up to about 60° C. in the shear rate range of 100-10,000 $s^{-1}$. For that reason the polymer solution according to the invention can be spun at a temperature below 60° C., preferably at room temperature. Further, the aramid dope of the present invention is free from an extra component as pyridine and can be produced advantageously from the industrial point of view in that the production process can be simplified and the process is free from the problem of corrosion of apparatuses by concentrated sulfuric acid as compared with the prior dopes using concentrated sulfuric acid as a solvent.

Further, according to the process of the present invention, the polymer solution can directly be spun, and the product can be made into fibrils, so that the process of production can be greatly simplified as compared with the prior production processes of aramid pulp, which is usually made by first making the yarn.

An aramid paper having a long breaking length can be produced from the aramid fibrils of the present invention. When used as a starting material of friction materials including paper for automatic transmission and the like, the performance is good. The fibrils are directly made from spinning the polymer solution, thus without making fibers.

The invention therefore also relates to aramid fibrils having a CSF (Canadian Standard Freeness) of never dried fibrils of less than 300, preferably of less than 150. With more preference, the para-aramid fibrils have a relative viscosity ($\eta_{rel}$) larger than 2.2.

In another embodiment, the invention also pertains to aramid paper obtainable from the fibrils of the invention. Such paper comprises at least 2 wt. %, preferably at least 5 wt. %, most preferably at least 10 wt. % of the aramid fibrils.

The present invention will now be explained in more detail below.

The stable spin dope has a para-aramid concentration of 2-6 wt. % and a moderate to high degree of polymerization to allow high relative viscosity ($\eta_{rel}$=about 2.0 to about 5.0). Depending on the polymer concentration, the dope exhibits an anisotropic (polymer concentration=2 to 6 wt. %) or an isotropic behavior. Preferably, the dynamic viscosity $\eta_{dyn}$ is smaller than 10 Pa·s, more preferably smaller than 5 Pa·s at a shear rate of 1000 $s^{-1}$. Neutralization takes place during or preferably after polymerizing the monomers forming the aramid. The neutralization agent is not present in the solution of monomers before polymerization has commenced. Neutralization reduces dynamic viscosity by a factor of at least 3. The neutralized polymer solution can be used for direct fibrils spinning using a nozzle, contacting the polymer stream by pressurized air in a zone with lower pressure where the polymer stream is broken into droplets by expansion of the air. The droplets are attenuated into fibrils. Coagulation of the fibrils takes place using a suitable coagulant as, e.g., water or water/NMP/$CaCl_2$ mixtures. Instead of $CaCl_2$, other chlorides such as LiCl may also be used. By adjusting the polymer flow/air flow ratio, the length and the CSF of the fibrils can be changed. At high ratios long fibrils are obtained, while at low ratios short fibrils are obtained. The specific surface area (SSA) of the fibrils decreases with decreasing Canadian Standard Freeness (CSF).

The fibrils of the present invention are useful as a starting material for para-aramid paper, friction materials including automobile brake, various gaskets, E-papers (for instance for electronic purposes, as it contains very low amounts of ions compared to para-aramid pulp made from sulfuric acid solutions), and the like.

Examples of the para-oriented aromatic diamine usable in the present invention include para-phenylenediamine, 4,4'-diaminobiphenyl, 2-methyl-paraphenylene-diamine, 2-chloro-paraphenylenediamine, 2,6-naphthalenediamine, 1,5-naphthalenediamine, and 4,4'-diaminobenzanilide.

Examples of para-oriented aromatic dicarboxylic acid halide usable in the present invention include terephthaloyl chloride, 4,4'-benzoyl chloride, 2-chloroterephthaloyl chloride, 2,5-dichloroterephthaloyl chloride, 2-methylterephthaloyl chloride, 2,6-naphthalenedicarboxylic acid chloride, and 1,5-naphthalenedicarboxylic acid chloride.

In the present invention, 0.950-1.050 mole, preferably 0.980-1.030, more preferably 0.995-1.010 mole of para-oriented aromatic diamine is used per 1 mole of para-oriented aromatic carboxylic acid halide in a polar amide solvent in which 0.5-4 wt. % of alkali metal chloride or alkaline earth metal chloride is dissolved (preferably 1-3 wt. %), making the concentration of para-aramid obtained thereof 2-6 wt. %, preferably 2-4 wt. %, more preferably 2.5-3.5 wt. %. In the present invention the polymerization temperature of para-aramid is −20° C. to 70° C., preferably 0° C. to 30° C., and more preferably 5° C. to 25° C. In this temperature range the dynamic viscosity is within the required range and the fibrils produced thereof by spinning can have sufficient degree of crystallization and degree of crystal orientation.

An essential feature of the present invention is that the polymerization reaction may be first enhanced and thereafter stopped by neutralizing the polymer solution or the solution forming the polymer by adding an inorganic or strong organic base, preferably calcium oxide or lithium oxide. In this respect the terms "calcium oxide" and "lithium oxide" comprise calcium hydroxide and lithium hydroxide, respectively. This neutralization effects the removal of hydrogen chloride, which is formed during the polymerization reaction. Neutralization results in a drop of the dynamic viscosity with a factor of at least 3 (with regard to non-neutralized corresponding solution). Per mole of the amide group formed in the polycondensation reaction, after neutralization the chlorides are preferably present in an amount of 0.5-2.5 moles, more preferably in an amount of 0.7-1.4 moles. The total amount of chloride may originate from $CaCl_2$, which is used in the solvent and from CaO, which is used as neutralizing agent (base). If the calcium chloride content is too high or too low, the dynamic viscosity of the solution is raised too much to be suitable as a spin solution.

The liquid para-aramid polymerization solution can be supplied with the aid of a pressure vessel to a spinning pump to feed a nozzle of 100-1000 μm for air jet spinning to fibrils. The liquid para-aramid solution is spun through a spinning nozzle into a zone of lower pressure. For air jet spinning more than 1 bar, preferably 4-6 bar is separately applied through a ring-shaped channel to the same zone where expansion of air occurs. Under the influence of the expanding air flow, the liquid spinning solution is divided into small droplets and at the same time or subsequently oriented by drawing. Then the fibrils are coagulated in the same zone by means of applying a coagulant jet and the formed fibrils are collected on a filter and washed. The coagulant is selected from water, mixtures of water, NMP and $CaCl_2$, and any other suitable coagulant.

The present invention will now be explained by way of the following non-limitative examples.

The methods of test and evaluation and criteria of judgment employed in the examples and comparative examples were as follows.

Test Methods

Relative Viscosity

The sample was dissolved in sulfuric acid (96%) at room temperature at a concentration of 0.25% (m/v). The flow time of the sample solution in sulfuric acid was measured at 25° C. in an Ubbelohde viscometer. Under identical conditions the flow time of the solvent is measured as well. The viscosity ratio is then calculated as the ratio between the two observed flow times.

Dynamic Viscosity

The dynamic viscosity is measured using capillary rheometry at room temperature. By making use of the Powerlaw coefficient and the Rabinowitsch correction, the real wall shear rate and the viscosity have been calculated.

Fiber Length Measurement

Fiber length measurement was done using the PULP EXPERT™ FS (ex Metso). As length the average length (AL), the length weighted length (LL), weight weighted length (WL) is used. The subscript 0.25 means the respective value for particles with a length >250 micron. The amount of fines was determined as the fraction of particles having a length weighted length (LL)<250 micron.

This instrument needs to be calibrated with a sample with known fiber length. The calibration was performed with commercially available pulp as indicated in Table 1.

TABLE 1

| Commercially available samples | AL mm | LL mm | WL mm | $AL_{0.25}$ mm | $LL_{0.25}$ mm | $WL_{0.25}$ mm | Fines % |
|---|---|---|---|---|---|---|---|
| A | 0.27 | 0.84 | 1.66 | 0.69 | 1.10 | 1.72 | 26.8 |
| B | 0.25 | 0.69 | 1.31 | 0.61 | 0.90 | 1.37 | 27.5 |
| C | 0.23 | 0.78 | 1.84 | 0.64 | 1.12 | 1.95 | 34.2 |

A KEVLAR ® 1F539, Type 979
B TWARON ® 1095, Charge 315200, 24-01-2003
C TWARON ® 1099, Ser. no. 323518592, Art. no. 108692

CSF 3 g (dry weight) of never dried fibrils are dispersed in 1 l water during 1000 beats in a Lorentz and Wettre desintegrator. A well-opened sample is obtained. The Canadian Standard Freeness (CSF) value is measured and corrected for slight differences in weight of the fibrils (Tappi 227).

Specific Surface Area (SSA) Determination

Specific surface area ($m^2/g$) was determined using adsorption of nitrogen by the BET specific surface area method, using a Gemin 2375 manufactured by Micromeretics. The wet fibrils samples were dried at 120° C. overnight, followed by flushing with nitrogen for at least 1 h at 200° C.

Evaluation of Optical Anisotropy (Liquid Crystal State)

Optical anisotropy is examined under a polarization microscope (bright image) and/or seen as opalescence during stirring.

Paper Strength

Hand sheets (70 $g/m^2$) were made of 100% fibrid material or of 50% fibrid and 50% TWARON® 6 mm fiber (TWARON® 1000). Tensile index (Nm/g) was measured according to ASTM D828 and Tappi T494 om-96 on dried paper (120° C.), wherein sample width is 15 mm, sample length 100 mm, and test speed 10 mm/min at 21° C./65% RH conditions.

EXAMPLE 1

Polymerization of para-phenyleneterephthalamide was carried out using a 2.5 $m^3$ Drais reactor. After sufficiently drying the reactor, 1140 l of NMP/$CaCl_2$ (N-methylpyrrolidone/calcium chloride) with a $CaCl_2$ concentration of 2.5 wt. % was added to the reactor. Subsequently, 27.50 kg of para-phenylenediamine (PPD) was added and dissolved at room temperature. Thereafter the PPD solution was cooled to 10° C. and 51.10 kg of terephthalic acid dichloride (TDC) was added. After addition of the TDC, the polymerization reaction was continued for 45 min. Then the polymer solution was neutralized with a calcium oxide/NMP-slurry (14.10 kg of CaO in 28 l NMP). After addition of the CaO-slurry, the polymer solution was stirred for at least another 15 min. This neutralization was carried out to remove the hydrogen chloride (HCl), which is formed during polymerization. A gel-like polymer solution was obtained with a PPTA content of 4.5 wt. % and having a relative viscosity of 2.8 (in 0.25% $H_2SO_4$). The obtained solution exhibited optical anisotropy and was stable for more than one month. The solution was diluted with NMP until a polymer concentration of 3.0% was obtained.

The 3% solution was supplied (120 l/h) to a spinning pump to feed a spinning nozzle with 20 holes of 350 μm. The spinning temperature was ambient. The PPTA was spun through the nozzle into a zone of lower pressure. An air jet of 6 bar (160 $Nm^3/h$) (normal cube per hour) was separately applied perpendicularly to the polymer stream through ring-shaped channels to the same zone where expansion of the air occurred. Thereafter, the fibrils were coagulated ($H_2O$/30% NMP/1.3% $CaCl_2$) in the same zone by means of applying a coagulant jet (600 l/h) through ring-shaped channels under an angle in the direction of the polymer stream and the formed fibrils were collected on a filter and washed. The spun fibrils have a CSF value of 83 ml characteristic for fibrils, while they have an SSA of only 0.63 $m^2/g$. When looking under a microscope a very fine structure is seen, which confirms the low CSF value. The $WL_{0.25}$ was 0.76 mm.

| PULP EXPERT FS | | | | | | |
|---|---|---|---|---|---|---|
| AL (mm) | LL (mm) | WL (mm) | $AL_{0.25}$ (mm) | $LL_{0.25}$ (mm) | $WL_{0.25}$ (mm) | Fines (%) |
| 0.18 | 0.38 | 0.66 | 0.46 | 0.58 | 0.76 | 46.3 |

EXAMPLE 2

Polymerization of para-phenyleneterephthalamide was carried out using a 160 l Drais reactor. After sufficiently drying the reactor, 64 l of NMP/$CaCl_2$ (N-methylpyrrolidone/calcium chloride) with a $CaCl_2$ concentration of 2.5 wt. % was added to the reactor. Subsequently, 1487 g of para-phenylenediamine (PPD) was added and dissolved at room temperature. Thereafter the PPD solution was cooled to 10° C. and 2772 g of TDC was added. After addition of the TDC, the polymerization reaction was continued for 45 min. Then the polymer solution was neutralized with a calcium oxide/NMP-slurry (776 g of CaO in NMP). After addition of the CaO-slurry, the polymer solution was stirred for at least another 15 min. This neutralization was carried out to remove the hydrogen chloride (HCl), which is formed during polymerization. A gel-like polymer solution was obtained with a PPTA content of 4.5 wt. % and having a relative viscosity of 2.7 (in 0.25% $H_2SO_4$). The obtained solution exhibited optical anisotropy and was stable for more than one month. The solution was diluted with NMP until a polymer concentration of 3.6% was obtained.

The 3.6% PPTA solution was supplied (16 kg/h) to a spinning pump to feed a spinning nozzle with 4 holes of 350 μm. The spinning temperature was ambient. The PPTA was spun through the nozzle into a zone of lower pressure. An air jet of 7 bar (45 $Nm^3/h$) was separately applied perpendicularly to the polymer stream through ring-shaped channels to the same zone where expansion of the air occurred. Thereafter, the fibrils were coagulated in the same zone by means of applying a water jet (225 l/h) through ring-shaped channels under an angle in the direction of the polymer stream and the formed fibrils were collected on a filter and washed.

The collected fibrils show higher SSA values, but still the SSA decreases while the CSF value also decreases (see Table 2).

TABLE 2

| | | | PULP EXPERT FS | | | | | | |
|---|---|---|---|---|---|---|---|---|---|
| | CSF (ml) | SSA ($m^2/g$) | AL (mm) | LL (mm) | WL (mm) | $AL_{0.25}$ (mm) | $LL_{0.25}$ (mm) | $WL_{0.25}$ (mm) | Fines (%) |
| A | 85.00 | 4.96 | 0.19 | 0.38 | 0.67 | 0.46 | 0.57 | 0.77 | 45.6 |
| B | 70.00 | 4.33 | 0.19 | 0.39 | 0.69 | 0.47 | 0.60 | 0.79 | 44.6 |
| C | 55.00 | 3.80 | 0.18 | 0.37 | 0.65 | 0.45 | 0.57 | 0.75 | 46.3 |

EXAMPLE 3

Paper was made of the never dried fibrils of Example 1. The paper strength of 50% TWARON® 1000 6 mm fiber and 50% fibrils was 23 Nm/g.

EXAMPLE 4

Paper was made of the never dried fibrils of Example 2. The paper strength of 50% TWARON® 1000 6 mm fiber and 50% fibrils was 18 Nm/g. The paper strength of paper consisting of 100% fibrils was 10.8 Nm/g.

The invention claimed is:

1. Aramid fibrils having in the wet phase a Canadian Standard Freeness (CSF) value less than 300 ml and after drying a specific surface area (SSA) less than 7 $m^2/g$ and a weight weighted length for particles having a length >250 μm ($WL_{0.25}$) less than 1.2 mm, wherein the fibrils are substantially free of fiber stems.

2. The fibrils of claim 1 wherein the aramid is poly(para-phenylene terephthalamide).

3. A paper made of constituents comprising at least 2 wt. % of the aramid fibrils of claim 1.

4. A paper made of constituents comprising at least 5 wt. % of the aramid fibrils of claim 1.

5. A paper made of constituents comprising at least 10 wt. % of the aramid fibrils of claim 1.

6. The fibrils of claim 1 wherein in the wet phase the CSF value is less than 150 ml and after drying the SSA is less than 1.5 $m^2/g$.

7. A paper made of constituents comprising at least 2 wt. % of the aramid fibrils of claim 6.

8. A paper made of constituents comprising at least 5 wt. % of the aramid fibrils of claim 6.

9. A paper made of constituents comprising at least 10 wt. % of the aramid fibrils of claim 6.

10. The fibrils of claim 1 wherein the aramid is para-aramid.

11. A paper made of constituents comprising at least 2 wt. % of the aramid fibrils of claim 10.

12. A paper made of constituents comprising at least 5 wt. % of the aramid fibrils of claim 10.

13. A paper made of constituents comprising at least 10 wt. % of the aramid fibrils of claim 10.

14. A method of preparing the fibrils of claim 1 comprising a. polymerizing an aromatic diamine and an aromatic dicarboxylic acid halide to an aramid polymer, in a mixture of N-methylpyrrolidone or dimethylacetamide and calcium chloride or lithium chloride, to obtain a dope wherein the polymer is dissolved in the mixture and the polymer concentration is 2 to 6 wt. %, b. converting the dope to fibrils by using a jet spin nozzle under a gas stream, wherein the fibrils are derived directly from the dope and are not derived from a pulp, and c. coagulating the fibrils using a coagulation jet.

15. The method according to claim 14 wherein at least part of the hydrochloric acid formed is neutralized to obtain a neutralized dope.

16. The method according to claim 15 wherein the $\eta rel$ (relative viscosity) of the aramid polymer is between 2.0 and 5.0.

* * * * *

UNITED STATES PATENT AND TRADEMARK OFFICE

CERTIFICATE OF CORRECTION

PATENT NO. : 7,629,047 B2
APPLICATION NO. : 10/582161
DATED : December 8, 2009
INVENTOR(S) : Josef Hendriks et al.

It is certified that error appears in the above-identified patent and that said Letters Patent is hereby corrected as shown below:

On title page

Item (30), please change "03028091" to --03028091.1--.

Changes to Specification,

Column 6, Line 42,
change "Gemin" to --Gemini--.

Signed and Sealed this

Ninth Day of February, 2010

David J. Kappos

David J. Kappos
*Director of the United States Patent and Trademark Office*